United States Patent [19]

Chaplin et al.

[11] 4,318,668

[45] Mar. 9, 1982

[54] SEAL MEANS FOR A GAS TURBINE ENGINE

[75] Inventors: Gary F. Chaplin, Vernon; Frederick M. Schwarz, Glastonbury; James G. Griffin, West Hartford, all of Conn.

[73] Assignee: United Technologies Corporation, Hartford, Conn.

[21] Appl. No.: 90,187

[22] Filed: Nov. 1, 1979

[51] Int. Cl.[3] ..... F01D 25/08

[52] U.S. Cl. ..... 415/135; 415/139; 415/178

[58] Field of Search ..... 60/39.75; 415/134, 135, 415/136, 137, 138, 139, 175, 178, 115, 116

[56] References Cited

U.S. PATENT DOCUMENTS

| | | | |
|---|---|---|---|
| 3,284,048 | 11/1966 | Tumavicus | 415/178 |
| 3,300,178 | 1/1967 | Rizk et al. | 415/115 |
| 3,825,364 | 7/1974 | Halila et al. | 415/116 |
| 3,825,365 | 7/1974 | Peng | 415/116 |
| 3,893,786 | 7/1975 | Rahnke et al. | 415/138 |
| 4,150,915 | 4/1979 | Karstensen | 415/139 |
| 4,177,004 | 12/1979 | Riedmiller et al. | 415/136 |
| 4,184,689 | 1/1980 | Brodell et al. | 415/134 |

FOREIGN PATENT DOCUMENTS

| | | |
|---|---|---|
| 1293577 | 10/1972 | United Kingdom . |
| 2033020 | 5/1980 | United Kingdom . |

*Primary Examiner*—Robert E. Garrett
*Attorney, Agent, or Firm*—Gene D. Fleischhauer

[57] ABSTRACT

A seal means for confining cooling air to a cooling air flowpath extending between a case structure and a flowpath for hot working medium gases in a gas turbine engine is disclosed. Various construction details which enable the seal means to block the leakage of cooling air into the working medium flowpath are discussed. The seal means has a center section which expands axially in response to the temperature of the working medium gases to develop a sealing force.

6 Claims, 3 Drawing Figures

SEAL MEANS FOR A GAS TURBINE ENGINE

BACKGROUND OF THE INVENTION

1. Field of the Invention

This invention relates to gas turbine engines, and more particularly to a seal means extending about the interior of the outer case of such an engine.

2. Description of the Prior Art

A gas turbine engine has a compression section, a combustion section and a turbine section. The turbine section has a rotor assembly and a stator assembly. An annular flowpath for working medium gases extends axially through the engine. The annular flowpath passes in alternating succession between components in the rotor assembly and components in the stator assembly. Components of the stator, including an outer case, circumscribe the annular flowpath. A flowpath for cooling air extends axially through the engine between the outer case and the flowpath for working medium gases.

In modern engines, the cooling air is flowed through passages on the interior of the case. The cooling air removes heat from the case and from turbine components such as vanes in intimate contact with the hot working medium gases. Along the cooling air flowpath, the cooling air is at a higher pressure than the surrounding gases. The case forms the outer boundary of the cooling air flowpath. An upstream boundary and a downstream boundary are formed in part by structure adjacent to the case and positioned by the case. A seal means extends between the adjacent structure to form an inner boundary of the flowpath.

In U.S. Pat. No. 3,992,126 to Brown et al., entitled "Turbine Cooling", an annular air cavity is formed between a circumferentially extending ring and the outer case. The upstream end of the ring opposes an outwardly facing surface on an upstream flange. A plurality of vane feet urge the upstream end of the ring into sealing contact with the upstream flange. The downstream end of the ring opposes an inwardly facing surface on a downstream flange and is securely attached to the downstream flange by bolts.

Notwithstanding the above art, scientists and engineers are still seeking to increase the sealing effectiveness of a seal means extending about the interior of an engine case between adjacent structures positioned by the engine case.

SUMMARY OF THE INVENTION

A primary object of the present invention is to increase the sealing effectiveness of a seal means which extends about the interior of an engine case between adjacent structures positioned by the engine case. An object is to provide a seal means with improved structural integrity and flexibility. Another object is to provide a seal means whose radial position about the axis of the engine is independent of radial excursions of the case.

According to the present invention a seal means disposed between the working medium flowpath and the engine case has a center section which elongates in operative response to the flow of working medium gases in the flowpath to develop a sealing force against adjacent structures.

A primary feature of the present invention is the proximity of the center section of the seal means to the working medium flowpath. The seal means has a center section extending in a first direction. Another feature is the flexible leg of the seal means which extends perpendicularly from the center section into sliding engagement with adjacent structures. In one detailed embodiment a second leg engages adjacent structure at a spline-type connection.

A principal advantage of the present invention is the sealing effectiveness resulting from the positive sealing force and the concentric positioning of the seal means. Cracking of the seal structure is avoided by providing a sliding contact with adjacent structures. In a detailed embodiment, the seal means is concentrically positioned about the axis of the engine by a spline-type connection. Circumferential hoop stresses are relieved by providing slots in the seal means. A flexible leg accommodates elongation of the center section.

The foregoing and other objects, features and advantages of the present invention will become more apparent in the light of the following detailed description of preferred embodiments thereof as discussed and illustrated in the accompanying drawing.

DETAILED DESCRIPTION

Figure 1:
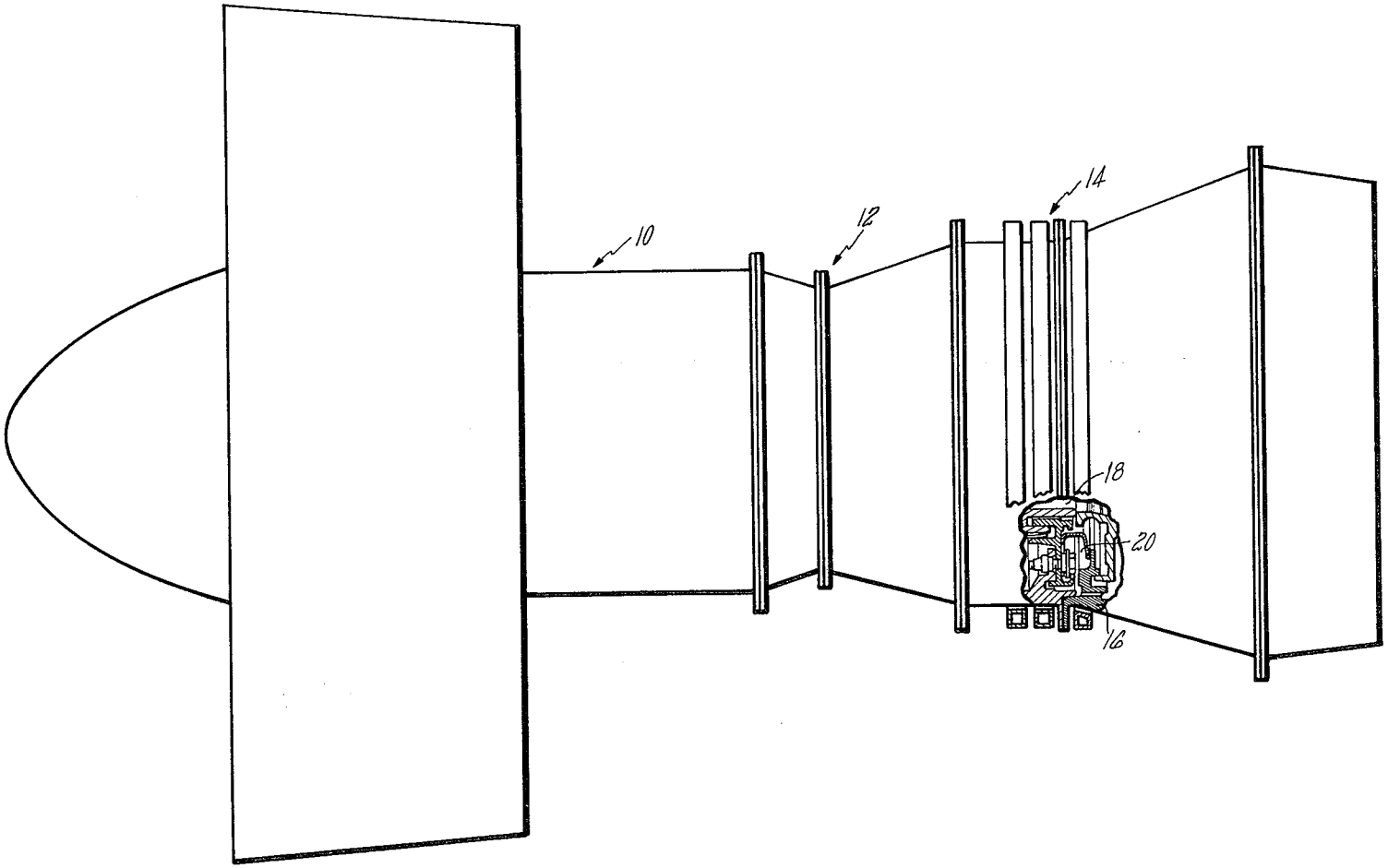
FIG. 1 is a simplified, side elevation view of a turbofan engine with a portion of an outer case broken away to reveal internal structures positioned by the outer case and a seal means extending therebetween.

A gas turbine engine embodiment of the invention is illustrated in FIG. 1. The principal sections of the engine include a compression section 10, a combustion section 12 and a turbine section 14. The turbine section includes a stator 16. An annular flowpath 18 for working medium gases extends axially through the engine. A flowpath 20 for cooling air circumscribes the flowpath for working medium gases in the turbine section of the engine.

Figure 2:
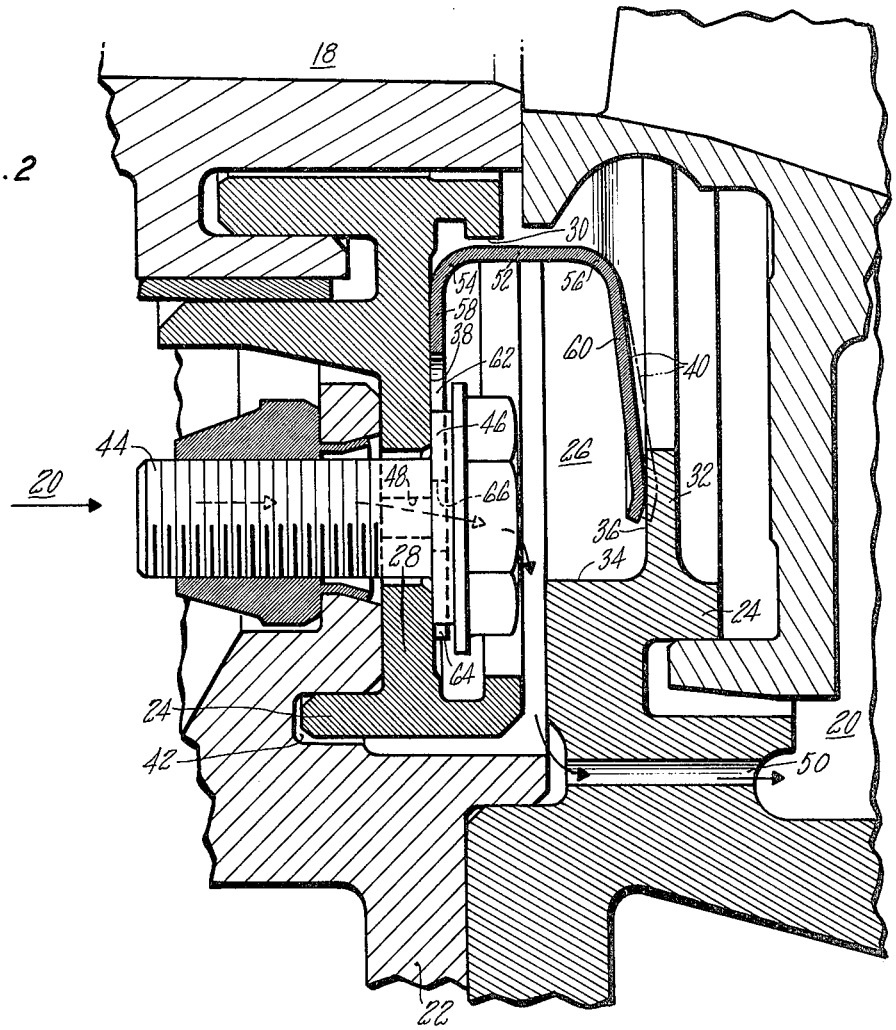
FIG. 2 is an enlarged sectional view of a portion of the outer case, the internal structures positioned by the outer case and a seal means extending therebetween.

FIG. 2 is an enlarged sectional view of a portion of the turbine section 14. In the turbine section, the stator has an outer case 22 and adjacent structure 24 attached to the case through which the flowpath 20 for cooling air passes. A portion 26 of the flowpath for cooling air is circumscribed by the outer case. The adjacent structure 24 has a first element, such as a support ring 28, extending inwardly of the flowpath for cooling air. The support ring has a plurality of surfaces, as represented by the single surface 30, facing outwardly. The adjacent structure 24 also has a second element spaced axially along the flowpath from the first element, such as a flange 32. The flange extends inwardly of the flowpath for cooling air and has a surface 34 facing inwardly and a substantially flat surface 36 facing forwardly. The support ring has a substantially flat surface 38 facing rearwardly opposing in part the substantially flat surface 36 of the flange. A seal means 40 extends between the rearwardly facing surface 38 of the flange to form an inner boundary for the portion 26 of the cooling air flowpath.

A circumferentially extending groove 42 adapts the outer case to receive the support ring 28. As those of ordinary skill in the art will appreciate, the support ring may be either a continuous ring or a segmented ring. An attachment means, such as the bolt 44 secures the support ring to the outer case. Each bolt has a shoulder 46. A passageway, such as one or more holes 48 penetrating the support ring, enables the flow of cooling air across the support ring. Similarly, the flange 32 has a passageway, such as one or more holes 50, to enable the flow of cooling air across the flange.

The seal means 40 has a center section 52 disposed in close proximity to the hot working medium gases 18. The center section has a first end, such as upstream end 54, and a second end, such as downstream end 56. A first leg, such as upstream leg 58, extends outwardly to slidably engage the support ring 28 at the rearwardly facing surface 38. The first leg is adapted by a plurality of radially extending slots, as represented by the single slot 62, to also slidably engage the shoulder 46 of each bolt 44 at a spline-type connection 64. A second leg, such as downstream leg 60, extends outwardly to slidably engage the flange 32 at the forwardly facing surface 32.

Figure 3:
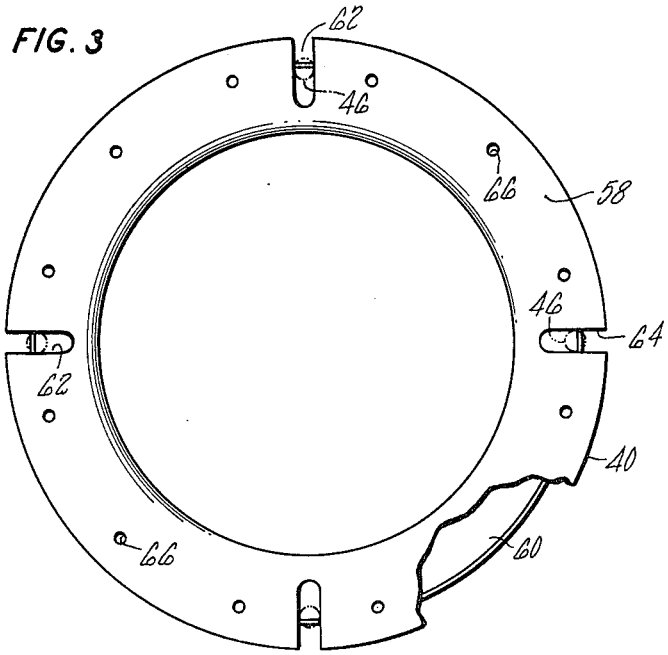
FIG. 3 is a front view of the seal means before installation in the engine with a portion of the upstream leg broken away to reveal the downstream leg.

FIG. 3 is a front view of the seal means 40 before installation in the gas turbine engine. The upstream leg 58 is shown with the radial slots 62. The plurality of bolt shoulders 46 are shown in phantom. The seal means has a plurality of holes 66. The holes 66 are larger than the holes 48 in the support ring 28. In the installed position, the holes 66 are always in gas communication with the holes 48.

During operation of the gas turbine engine, both hot working medium gases and cooling air enter the turbine section 14 of the engine. The hot working medium gases follow the flowpath 18 into the turbine section. Components of the turbine section, including the seal means 40, the outer case 22 and the adjacent structure 24 positioned by the case, such as support ring 28 and flange 32, are heated by the working medium gases. High pressure cooling air following the flowpath 20 enters through the holes 48 through the support ring into the circumferentially extending portion of the flowpath between the rearwardly facing surface 38 and the forwardly facing surface 36 and thence passes through the holes 50 in the flange of the outer case to downstream locations.

The components of the engine respond thermally at different rates to heating by the working medium gases and cooling by the cooling air. The seal means 40 has a thermal capacitance that is much smaller than the thermal capacitance of the outer case 22. The seal means is also in closer proximity to the hot working medium gases 18 than is the outer case. Accordingly the seal means responds more quickly to changes in gas path temperature than does the outer case. An increase in the temperature of the hot working medium gases, such as occurs during accelerations and startup, causes the seal means to move outwardly with respect to the outer case and to the adjacent structure 24 such as support ring 28 and flange 32 by sliding along the shoulder 46 of each bolt 44 at the corresponding spline-type connection 64. The case responds more slowly than does the seal means 40 and reaches a steady-state position after the seal means. Before the case reaches a steadystate condition, the case grows outwardly away from the seal means, sliding with respect to the upstream leg 58 and the downstream leg 60. Because the case is able to slide with respect to the seal means and because the seal means is able to slide with respect to the case, stresses resulting from differences in thermal growth between the seal means and the case are avoided. Concentric positioning of the seal means about the axis of the engine is insured by the spline-type connection 64 between the seal means and the support ring.

The seal means 40 blocks the leakage of cooling air from the flowpath for cooling air by sealingly engaging the rearwardly facing surface 38 and the forwardly facing surface 36. The center section 52 of the seal means is in closer proximity to the hot working medium gases than is the upstream leg 58 or the downstream leg 60. As the seal means is heated, the center section expands axially causing the downstream leg and the upstream leg to exert an axial sealing force against the respective surfaces 36, 38. This axial sealing force increases the axial force exerted by the upstream leg and the downstream leg as a result of the compression of the seal means during installation. The dotted lines in FIG. 2 show the free position of the seal means before installation. The high pressure cooling air flowing along the flowpath 20 exerts an additional sealing force against the upstream leg and the downstream leg because of the initial seal resulting from the compression during assembly and the axial growth of the center section.

The seal means is adapted to accommodate axial and radial stresses at critical locations. The flexibility of the downstream leg 60 accommodates differences in axial growth between the outer case and the seal means to insure that stresses in the seal means are not so great as to cause cracking and to insure that an adequate sealing force is exerted against the upstream wall and the downstream wall. The outer portion of the upstream leg 58 is in intimate contact with the high pressure cooling air. The inner end of the upstream leg is integral with the center section of the seal means, in close proximity to the hot working medium gases. A large hoop stress normally associated with the temperature gradient between the inner portion of the upstream leg and the outer portion of the upstream leg is avoided by the radially extending slots 62 which break up the circumferential continuity of the upstream leg.

As will be appreciated by those of ordinary skill in the art, the seal means 40 may be kept relatively concentric to the center line of the engine even without the spline-type connection 64. In constructions where there are no spline-type connections, the outwardly facing surface 30 of the support ring 28 and the inwardly facing surface 34 of the flange 32 cooperate to confine the seal means to a radial position which approximates a concentric orientation about the engine axis. As those of ordinary skill in the art will also appreciate such a positioning will result in stresses caused by occasional interferences between the seal means and the inwardly facing surface or between the seal means and the outwardly facing surface. As will also be appreciated by those skilled in the art, the passage of cooling air through the groove 42, between the support ring 28 and the outer case 22, may obviate the need for cooling air holes 48 and 66.

Although this invention has been shown and described with respect to a preferred embodiment thereof, it should be understood by those skilled in the art that various changes and omissions in the form and detail thereof may be made therein without departing from the spirit and scope of lthe invention.

Having thus described a typical embodiment of our invention, that which we claim as new and desire to secure by Letters Patent of the United States is:

1. In a gas turbine engine of the type having a flowpath for hot working medium gases which is circumscribed by an engine case and having a flowpath for cooling air disposed between the flowpath for working medium gases and the engine case, and further including first and second elements extending from the engine case across the flowpath for cooling air, wherein the improvement comprises:

means inwardly of the engine case extending between said first and second elements and extending to define a flowpath for pressurized cooling air between said means and the engine case, said means having a first side in heat transfer communication with the hot working medium gases and a second side in gas communication with the pressurized cooling air wherein said means is adapted to develop a sealing force against said first element and said second element in response to the flow of pressurized cooling air and by elongating in operative response to the flow of hot working medium gases in the working medium flowpath.

2. The invention as claimed in claim 1 wherein the means for defining a flowpath for cooling air has a center section in close proximity to the hot working medium flowpath which elongates in operative response to the flow of hot working medium gases in the working medium flowpath.

3. In a gas turbine engine of the type having a flowpath for hot working medium gases which is circumscribed by an engine case and having a flowpath for cooling air disposed between the flowpath for working medium gases and the engine case, and further including first and second elements extending from the engine case across the flowpath for cooling air, wherein the improvement comprises:

means inwardly of the engine case extending between said first and second elements and extending to define a flowpath for cooling air between said means and the engine case, said means having a center section in close proximity to the hot working medium flowpath, a first leg extending outwardly from the center section to slidably engage said first element, and a second leg spaced axially from said first leg, the second leg extending outwardly to slidably engage said second element, wherein the center section adapts the means to develop a sealing force by elongating which causes the first leg and the second leg to exert a sealing force against the first element and the second element in operative response to the flow of hot working medium gases in the hot working medium flowpath and wherein the slidable engagement between the seal means and both the first and second elements adapts the means to provide sealing and accommodate differences in radial growth between the seal means and the adjacent elements.

4. The invention as claimed in claim 3 which further includes a spline-type connection joining the first leg to the first element.

5. The invention as claimed in claim 3 wherein the first element has an outwardly facing surface and the second element has an inwardly facing surface and wherein the means for defining a flowpath for cooling air is trapped radially between the outwardly facing surface on the first element and the inwardly facing surface on the second element.

6. The invention as claimed in claim 4 or claim 5 wherein the second leg has a portion extending in a substantially radial direction from the center section and wherein the second leg bears against the second element a sufficient distance from the center section to enable the seal means to flexibly engage the second element to accommodate elongation of the center section.

* * * * *